US007089899B1

(12) United States Patent
Genise et al.

(10) Patent No.: US 7,089,899 B1
(45) Date of Patent: Aug. 15, 2006

(54) STAMPED TWO-STEP ROCKER ARM COMPONENT

(75) Inventors: David G. Genise, Marshall, MI (US); Austin R. Zurface, Hastings, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/178,266

(22) Filed: Jul. 11, 2005

(51) Int. Cl.
*F01L 1/18* (2006.01)

(52) U.S. Cl. ..... 123/90.39; 123/90.44; 29/888.2

(58) Field of Classification Search ..... 123/90.16, 123/90.2, 90.39, 90.44; 29/888.2; 74/559, 74/569

See application file for complete search history.

(56) References Cited

U.S. PATENT DOCUMENTS 4,624,233 A 11/1986 Phillips
5,010,857 A 4/1991 Hempelmann et al.
5,655,488 A 8/1997 Hampton et al.
6,601,555 B1 * 8/2003 Okubo et al. ..... 123/90.39
6,981,479 B1 * 1/2006 Abe ..... 123/90.39

* cited by examiner

*Primary Examiner*—Thomas Denion
*Assistant Examiner*—Ching Chang
(74) *Attorney, Agent, or Firm*—Bradley J. Diedrich; L. J. Kasper

(57) ABSTRACT

A rocker arm (25) adapted to engage a pair of cam lobes (15,17), the rocker arm having first (31) and second (33) sidewall portions, and being formed from a flat sheet metal blank (25B) having a nominal thickness (T). The sidewall portions (31,33) define fold regions (51,53) whereby, after each is folded over upon itself, and the rocker arm is formed to have the sidewall portions generally parallel to each other, the fold regions provide first (41) and second (43) cam contact surfaces, each having a width (W) substantially greater than the nominal thickness of the blank.

10 Claims, 5 Drawing Sheets

STAMPED TWO-STEP ROCKER ARM COMPONENT

BACKGROUND OF THE DISCLOSURE

The present invention relates to rocker arms for use in valve control systems of internal combustion engines, and more particularly, to rocker arms of the type which are formed from a flat metal blank.

Rocker arms are commonly used in internal combustion engines as part of a valve control system, i.e., a system which is able to control the movement (opening and closing) of an engine poppet valve. Typically, the rocker arm is utilized to transmit motion from a rotating camshaft, and specifically, from a cam lobe, to the engine poppet valve, by means of the rocker arm. As is well known to those skilled in the art, there is a substantial load applied by the "lift portion" of the cam lobe to the rocker arm, as the engine poppet valve is being moved to the open position, typically in opposition to the biasing force of a valve return spring.

Among the more common type of valve control systems are those in which the rocker arm is of the "center-pivot" type, in which the rocker arm pivots about a centrally located rocker shaft while one axial end of the rocker arm engages the engine poppet valve, and the cam lobe engages the axially opposite end of the rocker arm. Another common type of valve control system is one in which the rocker arm is of the "end-pivot" type, in which one end of the rocker arm pivots about a generally stationary member (such as a hydraulic lash adjuster), the axially opposite end engages the engine poppet valve, and the cam lobe engages a cam follower or cam contact surface disposed intermediate the axially opposite ends of the rocker arm. The above-described valve control system is typically referred to as an OHC (overhead cam) system. There could also be other rocker arm types, beside the center-pivot and end-pivot types, but most rocker arms in commercial use comprise one of these two types. However, it should be understood that, although the OHC type valve control system is the preferred embodiment, the present invention is not necessarily limited to any one particular type of rocker arm, in terms of the pivot location of the rocker arm.

Some known valve control systems for engine poppet valves utilize only a single rocker arm, but in recent years, those skilled in the art have developed a number of various valve control systems which utilize two separate rocker arms which may, selectively, be "latched" to move in unison, or may be "unlatched" to be pivotable relative to each other. By way of example only, such a valve control system, utilizing two rocker arms, may provide "dual lift" in which, for example, when the rocker arms are latched, one cam lobe engages one of the rocker arms to provide high lift of the engine poppet valve, whereas, when the rocker arms are unlatched, a different cam profile engages the other rocker arm to provide a low lift of the engine poppet valve. Examples of such dual lift, latchable rocker arm valve control systems are shown in U.S. Pat. Nos. 5,524,580; 5,584,267; and 5,655,488, all of which are assigned to the assignee of the present invention and incorporated herein by reference.

Although the present invention may be utilized to provide an improved rocker arm for use in a single rocker arm valve control system, or to provide either the inner or the outer rocker arm in a dual rocker arm system, it is especially advantageous when used to provide the outer, high lift rocker arm in a dual lift system, and will be described in connection therewith.

One of the conventional, prior art methods utilized to manufacture rocker arms is to form the "rough" rocker arm by any one of a number of well known processes, such as investment casting, and then to finish-machine all of the various important surfaces, dimensions, etc. Rocker arms made in this manner typically have excellent mechanical properties, but are also normally quite expensive, especially considering that, by way of example, a six cylinder engine would require at least twelve rocker arms, and in some cases, as many as eighteen or twenty-four rocker arms.

In many engine applications, the rocker arms are formed as steel stampings, in order to reduce substantially the manufacturing cost of each rocker arm. However, for many engine valve control systems, a stamped rocker arm may not possess the mechanical properties required for that particular valve control system especially in the case of dual rocker arm systems. Such a stamped rocker arm may be especially insufficient in regard to the cam follower surface of the rocker arm, i.e., the surface which engages the lift portion of the cam lobe during engine poppet valve "lift".

BRIEF SUMMARY OF THE INVENTION

Accordingly, it is an object of the present invention to provide an improved rocker arm, and an improved method for manufacturing such a rocker arm, which will result in a rocker arm having the low manufacturing cost of a stamped rocker arm, while at the same time, having mechanical properties which are substantially better than the prior art, stamped rocker arms.

It is a more specific object of the present invention to provide a rocker arm, and a method of manufacture thereof, which achieves the above-stated object, but in which the cam contact surfaces may be comparable, in terms of mechanical properties, to those which would be provided on a typical, prior art cast rocker arm.

It is an even more specific object of the present invention to provide a rocker arm, and a method of manufacture thereof, in which the starting material is a flat metal blank having a nominal thickness, wherein the final rocker arm includes cam contact surfaces having a width substantially greater than the nominal thickness of the metal blank.

The above and other objects of the invention are accomplished by the provision of an improved rocker arm for use in a valve control system of an internal combustion engine, including an engine poppet valve adapted to be moved between open and closed positions in response to rotation of a camshaft having first and second cam profiles. Each cam profile includes a base circle portion and a lift portion. The rocker arm comprises first and second sidewall portions, substantially parallel to an axis, and a connecting portion interconnecting the first and second sidewall portions. The rocker arm is formed from a flat sheet metal blank having a nominal thickness.

The improved rocker arm is characterized by each of the first and second sidewall portions including an enlarged portion defining a fold region whereby, after each of the enlarged portions is folded over on itself along the fold region, and the blank is formed to comprise the rocker arm, the fold regions are parallel to, and equally and oppositely disposed about the rocker arm axis. The first and second enlarged portions, after being folded, comprise first and second cam contact surfaces, respectively, for engagement with the first and second cam profiles, respectively. Each of the cam contact surfaces has a width, in the direction perpendicular to said rocker arm axis, wherein the width is substantially greater than the nominal thickness of the flat sheet metal blank.

Also provided is an improved method of forming a rocker arm, from a flat sheet metal blank, having a nominal thickness, the rocker arm being adapted to engage first and second cam profiles defined by a camshaft. The rocker arm has first and second sidewall portions, adapted to be engaged by the first and second cam profiles, respectively, and a connecting portion interconnecting the first and second sidewall portions. The rocker arm defines a rocker arm axis oriented generally perpendicular to the connecting portion.

The method of forming comprises, in any order, the steps of forming the flat sheet metal blank into a generally U-shaped configuration wherein the connecting portion remains generally perpendicular to the rocker arm axis, and the first and second sidewall portions are oriented substantially parallel to the axis. The other step is folding the first and second sidewall portions over upon themselves, whereby the first and second sidewall portions provide first and second cam contact surfaces, respectively, adapted to engage the first and second cam profiles, respectively. Each of the cam contact surfaces has a width wherein the width is substantially greater than the nominal thickness of the sheet metal blank.

DETAILED DESCRIPTION OF THE PREFERRED EMBODIMENT

Figure 1:
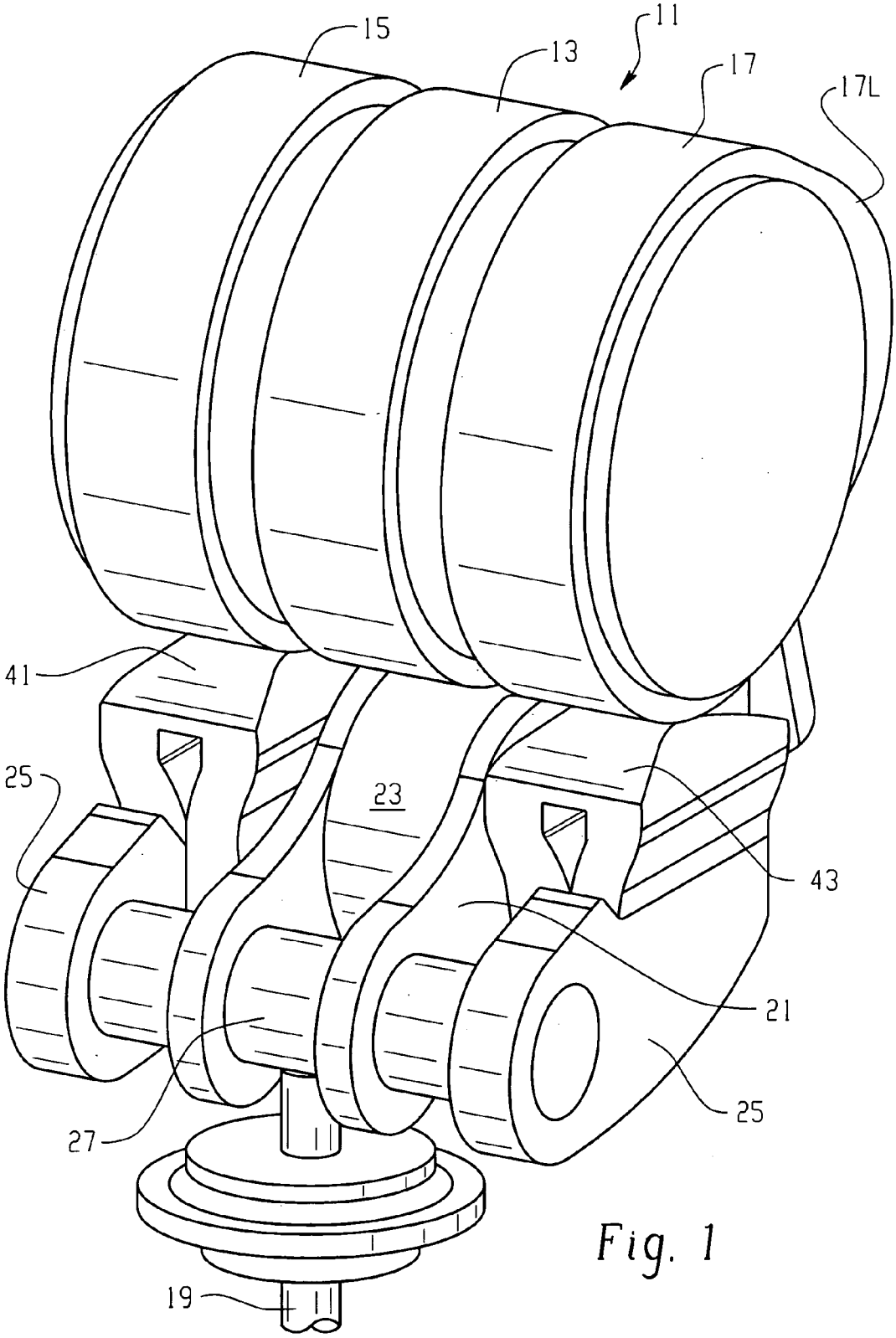
FIG. 1 is a somewhat fragmentary, perspective view of a valve control system including a rocker arm made in accordance with the present invention.

Referring now to the drawings, which are not intended to limit the invention, FIG. 1 illustrates a valve control system of the OHC (overhead cam) type, and which could utilize a rocker arm made in accordance with the present invention. The valve control system includes a camshaft generally designated 11, including a "low lift" cam lobe 13, and a pair of "high lift" cam lobes 15 and 17, disposed on axially opposite sides of the low lift cam lobe 13. As is well known to those skilled in the art, each of the cam lobes 13, 15 and 17 include a base circle portion (what is primarily visible in FIG. 1) and a lift portion. The lift portion of the cam lobe 17, designated 17L, is shown in FIG. 1, toward the right side of the view, whereas the lift portions of the cam lobes 13 and 15 are not visible in FIG. 1.

Referring still to FIG. 1, the rotation of the camshaft 11 is utilized to transmit opening and closing motion, by means of a valve control system, to an engine poppet valve 19, only the upper end of the valve stem being shown in FIG. 1. The valve control system comprises an inner rocker arm 21 including a pair of sidewalls between which is disposed a roller member 23, the roller member 23 comprising a low lift cam follower, which is in engagement with the low lift cam lobe 13.

Disposed about the inner rocker arm 21 is an outer rocker arm 25, which will be described in greater detail subsequently. In the subject embodiment, and by way of example only, a generally cylindrical pivot axle 27 (which may also serve as a valve stem tip pad portion) passes through aligned holes in the sidewalls of the inner rocker arm 21 and the outer rocker arm 25, thus defining a pivot axis, about which occurs relative pivotal movement between the rocker arms 21 and 25, as is conventional, and as is well known in dual rocker arm valve control systems. It should be understood that the present invention is not limited to any particular arrangement of (location of) the pivot axle and the rocker arms, nor is the invention even limited to the presence of a pivot axle, although what is shown herein is one preferred embodiment.

As is also well known to those skilled in such dual rocker arm or dual lift valve control systems, there would typically be provided some sort of a fulcrum member (such as a hydraulic lash adjuster, not shown herein), disposed at the end of the rocker arms opposite the pivot axle 27. The valve control system of the type shown herein would also typically include some sort of latching member (also not shown herein), operable, selectively, either to latch the rocker arms 21 and 25 together to pivot in unison about the pivot axle 27, or to allow the rocker arms 21 and 25 to pivot relative to each other, about the pivot axle 27. The fulcrum arrangement referred to above, as well as the latching arrangement, are both beyond the scope of the present invention, and because both are well known to those skilled in the art, they will not be described further herein.

When the valve control system shown in FIG. 1 is in the unlatched condition, and with the inner rocker arm 21 seated, as is typically the case, on the fulcrum arrangement, rotation of the camshaft 11 causes the low lift cam lobe 13 to force the roller member 23 downward, imparting a "low lift" to the engine poppet valve 19. When the latch member is in place, such that the valve control system is in the latched condition, the outer rocker arm 25 is latched relative to the inner rocker arm 21, and rotation of the camshaft 11 causes the high lift cam lobes 15 and 17 to force the outer rocker arm 25 downward, imparting a "high lift" to the engine poppet valve. The outer rocker arm 25 will now be described in greater detail.

Figure 2:
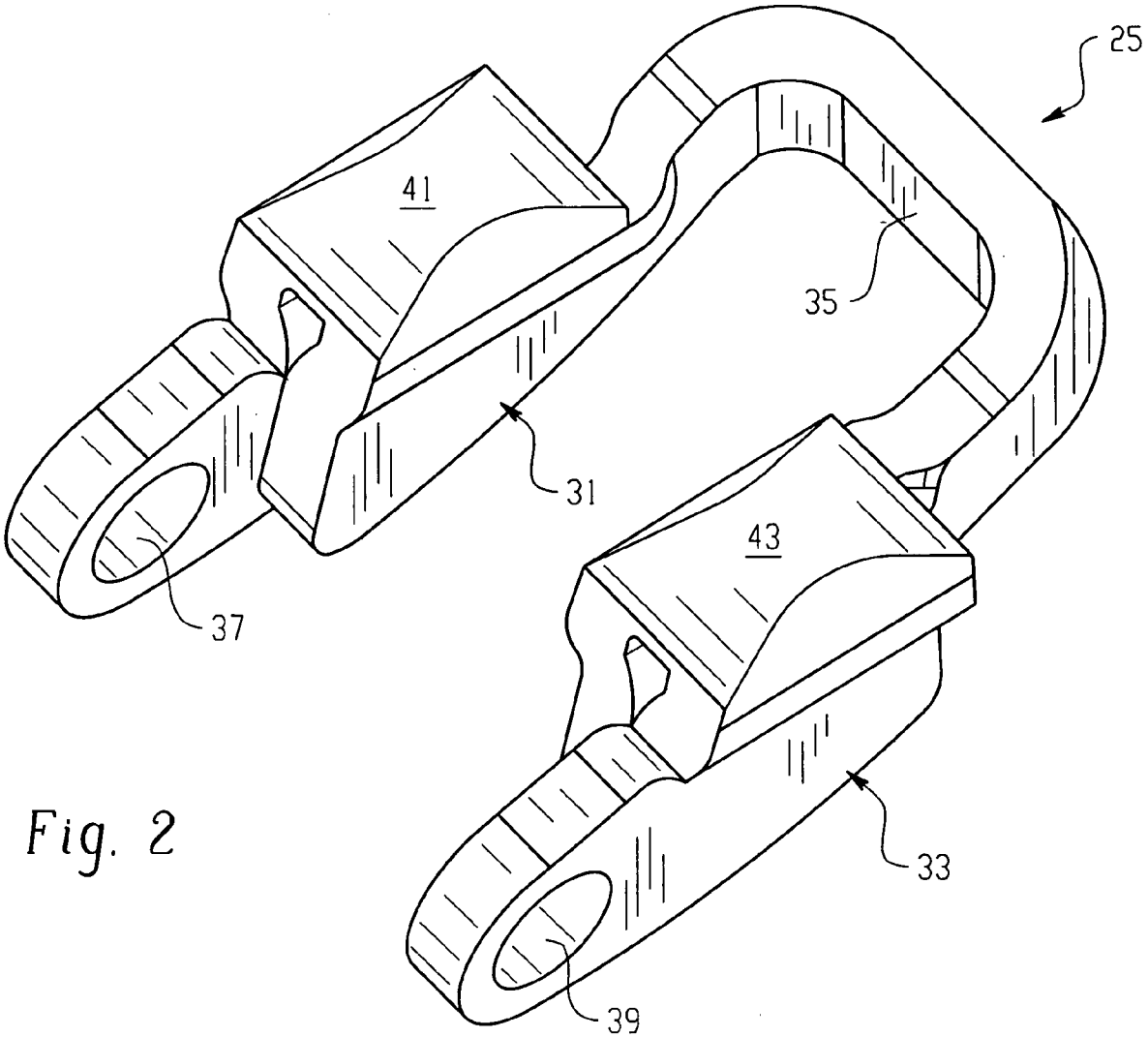
FIG. 2 is a perspective view of the rocker arm of the present invention, viewed at approximately the same angle as in FIG. 1.

Referring now primarily to FIG. 2, the outer rocker arm 25, which in accordance with one aspect of the invention is made as a sheet metal stamping, comprises a first sidewall portion, generally designated 31, and a second sidewall portion, generally designated 33, the portions 31 and 33 being generally parallel to each other and connected to each other by a connecting portion 35. The first sidewall portion 31 defines an opening 37 and the second sidewall portion 33 defines an opening 39, the openings 37 and 39 being circular, and accommodating the pivot axle 27, as was generally described previously.

The first sidewall portion 31 includes a first cam contact surface 41, and the second sidewall portion 33 includes a second cam contact surface 43. The cam contact surfaces 41 and 43 are partially visible in FIG. 1, and are in engagement with the high lift cam lobes 15 and 17, respectively. As may be seen even in FIG. 2, and in accordance with one important aspect of the invention, each of the first and second cam contact surfaces 41 and 43 has a width substantially greater than the nominal thickness of the sheet metal blank from which the outer rocker arm 25 is formed, as will be described in greater detail subsequently. As may best be seen in FIG. 1, and as is convention in such dual lift, dual rocker arm systems, the axial width of each of the high lift cam lobes is substantially greater than the thickness of the sheet from which the outer rocker arm 25 is formed. As is well known in the art, the width of the cam lobes 15 and 17 is typically selected, at least in part, to accommodate the load which must be transmitted to the rocker arm 25 to provide sufficient opening force to the engine poppet valve 19.

Figure 3:
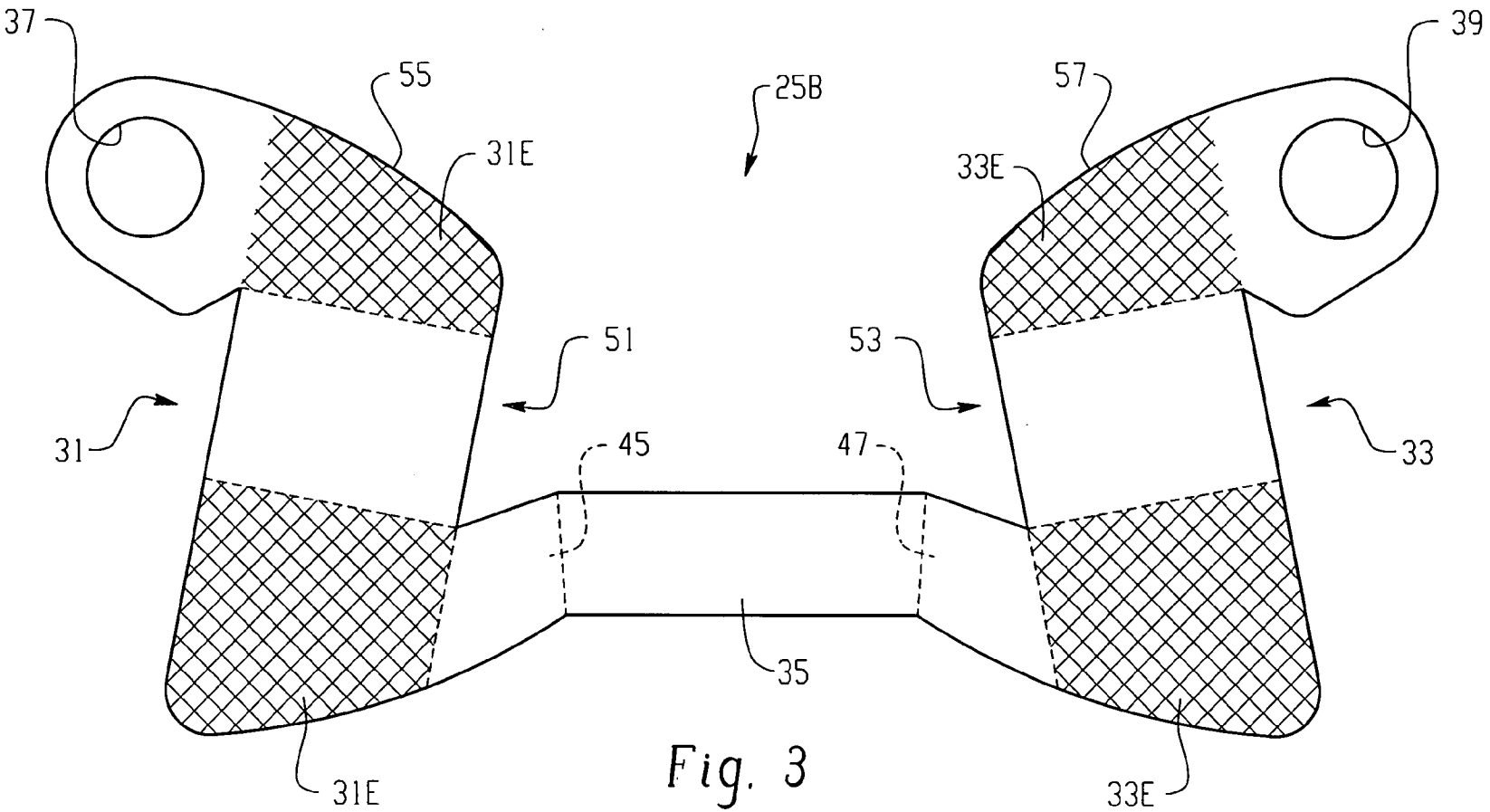
FIG. 3 is a plan view of a flat sheet metal blank from which the rocker arm of the present invention is formed, utilizing the method of forming in accordance with the present invention.

Referring now primarily to FIG. 3, there is illustrated a plan view of a flat sheet metal blank, generally designated 25B, which is formed, preferably by a stamping operation, to provide the shape shown in FIG. 3, in preparation for subsequent forming operations, to ultimately provide the rocker arm 25 shown in FIG. 2. Included in the view of FIG. 3, to facilitate an understanding of the process of forming the rocker arm 25 in accordance with the present invention, are a number of dashed lines, each of which indicates a location at which the flat sheet metal blank is folded, to yield the final configuration of the rocker arm 25. Therefore, the blank includes fold locations 45 and 47, the fold location 45 representing a transition from the connecting portion 35 to the first sidewall portion 31, and similarly, the fold location 47 representing a transition from the connecting portion 35 to the second sidewall portion 33.

Figure 5:
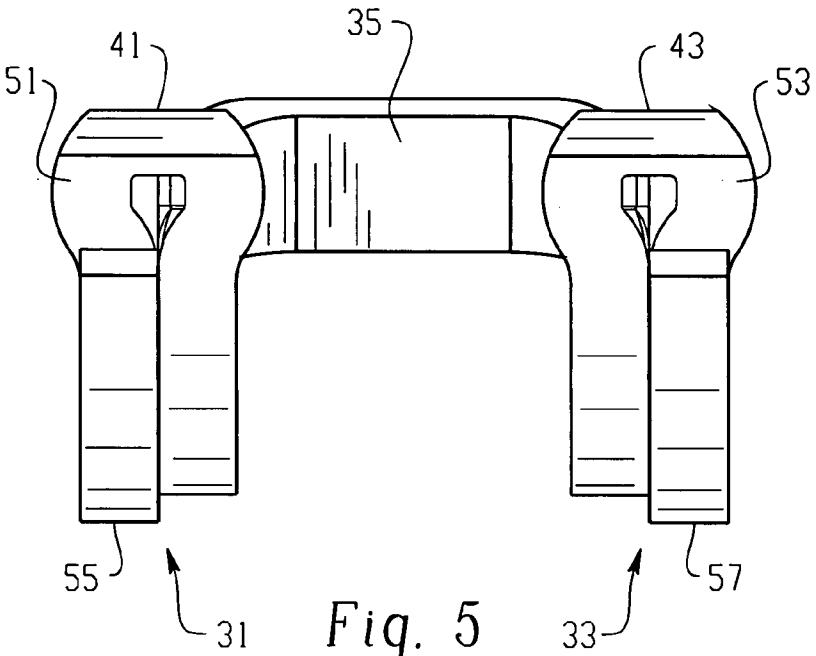
FIG. 5 is an end view of the rocker arm of the present invention.

The first sidewall portion 31 defines a fold region 51, while the second sidewall portion 33 defines a fold region 53. The term "region" is used in regard to the fold regions 51 and 53, rather than the term "location" as was the case for the fold locations 45 and 47 for reasons which may best be seen by viewing the sidewall portions 31 and 33 in FIGS. 2 and 5. Furthermore, the first sidewall portion 31 defines a pair of first "surface" portions 31E (the hatched portions of FIG. 3 on either side of the fold region 51), and the second sidewall portion 33 defines a pair of second "surface" portions 33E (the hatched portions of FIG. 3 on either side of the fold region 53). The significance of these enlarged portions 31E and 33E will be described subsequently.

In forming the rocker arm 25 from the sheet metal blank 25B shown in FIG. 3, the first step is to fold the "top" half of the blank 25B about the fold regions 51 and 53, such that, what appears as an "upper edge" 55 of the first sidewall portion 31 in FIG. 3 will now be a "bottom" edge 55 (see FIG. 5) after the folding operation. Similarly, what appears as an "upper edge" 57 of the second sidewall portion 33 in FIG. 3 will now be a "bottom" edge 57 (see FIG. 5) after the folding operation. After the folding operations described above, the connecting portion 35 will be disposed in a line (in the same plane) between the sidewall portions 31 and 33. More importantly, for purposes of the present invention, after the folding operation described above, the surface portions 31E are folded over upon each other (about a 180 degree fold), such that the upper portion 31E is in face-to-face engagement with the lower portion 31E. Similarly, the surface portions 33E are folded over upon each other (about a 180 degree fold), such that the upper portion 33E is in face-to-face engagement with the lower portion 33E. The result of this folding operation may best be seen in FIG. 5.

Figure 4:
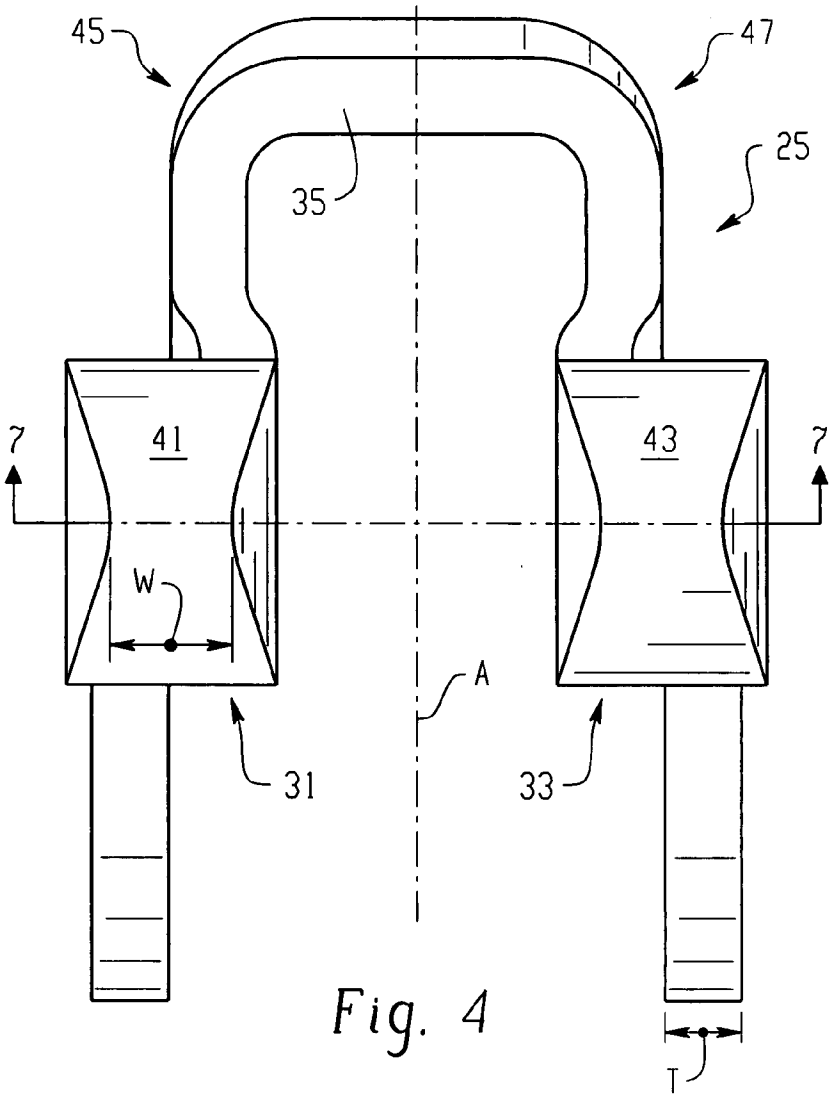
FIG. 4 is a top plan view of the rocker arm of the present invention after it is completely formed.
Figure 6:
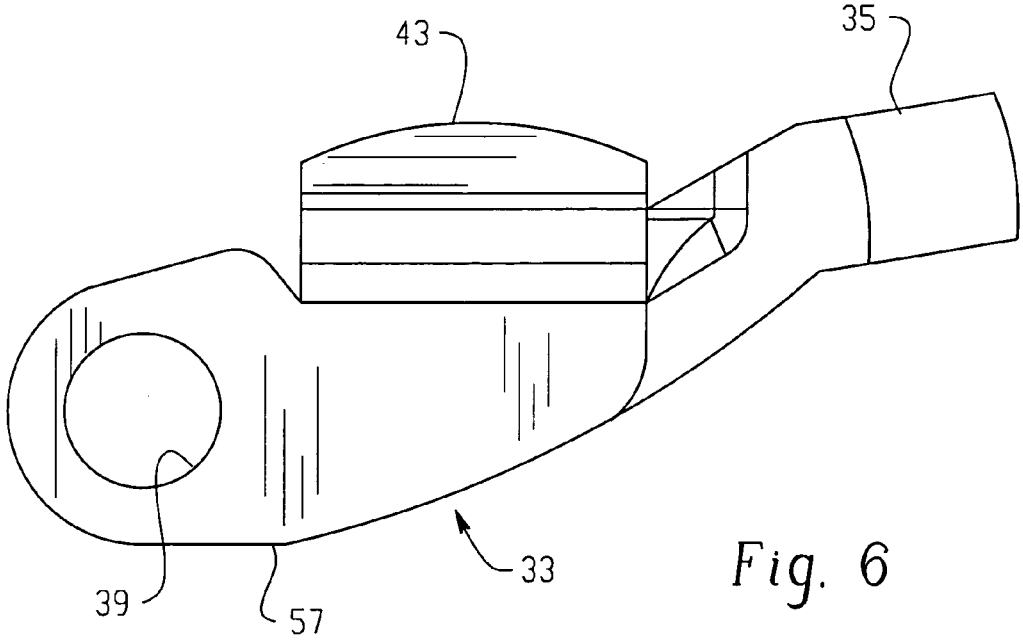
FIG. 6 is a side plan view of the rocker arm of the present invention.

After the blank 25B is folded about the fold regions 51 and 53, the next step is to fold the blank into the generally U-shaped configuration best seen in FIGS. 2 and 4. Thus, at the fold location 45, approximately a 90 degree fold (bend) is made, such that the sidewall portion 31 is now about perpendicular to the connecting portion 35. Similarly, at the fold location 47, approximately a 90 degree fold (bend) is made, such that the sidewall portion 33 is now about perpendicular to the connecting portion 35. As may best be seen in FIG. 4, after the folds about the fold locations 45 and 47, the sidewall portions 31 and 33 are disposed to be generally parallel to an axis A of the rocker arm 25. This "axis" A of the rocker arm 25 is perpendicular to (but vertically offset from) the axis of the camshaft 11, as will be understood by viewing FIG. 4, in conjunction with FIG. 1.

It should be understood that there is not shown herein a drawing representative of the rocker arm 25 immediately after the above-described folding steps, i.e., about the fold regions 51 and 53 and about the fold locations 45 and 47. Instead, the views in FIGS. 2 and 4—7 are representative of the rocker arm 25 after one additional process step is performed, that of further processing the cam contact surfaces 41 and 43. Typically, one sub-step in the further processing of the rocker arm 25 would be to grind the first and second cam contact surfaces 41 and 43, to provide the flattened (but curved, see FIG. 6) areas bearing the references numerals "41" and "43" in FIGS. 2 and 4—7. In accordance with one further aspect of the invention, the process of folding over the enlarged portions 31E and 33E, and then grinding the cam contact surfaces 41 and 43 results in those surfaces each having a width "W" (in a direction perpendicular to the axis A of the rocker arm) which is substantially greater than a thickness "T" of the sheet metal blank which serves as the starting material to create the rocker arm 25. This comparison of the width W and the thickness T may best be seen in FIG. 4, although it should be understood that the present invention is not limited to any particular relationship between the width W and the thickness T.

After the grinding step described previously, there may be other, and additional, process steps relating to the overall hardness of the rocker arm 25, or relating to the hardness of, specifically, the first and second cam contact surfaces 41 and 43. Also, there may be further processing steps performed which involve effecting the metallurgical properties of the first and second cam contact surfaces 41 and 43. It is believed to be within the ability of those skilled in the metallurgical arts to perform such additional processing steps to achieve whatever metallurgical and/or hardness characteristics are desired for the rocker arm 25.

Figure 7:
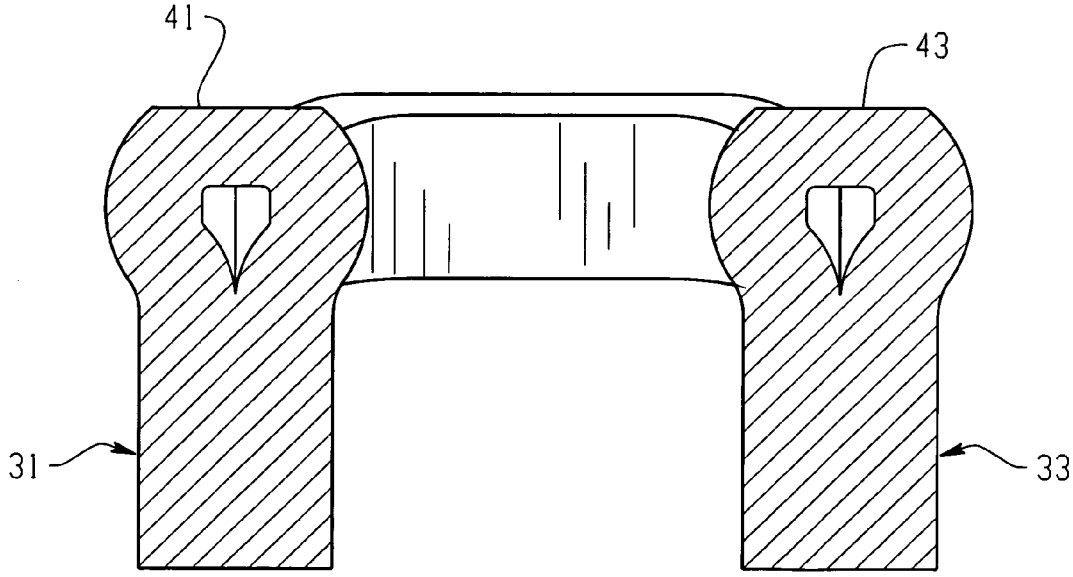
FIG. 7 is a transverse cross-section, taken on line 7—7 of FIG. 4.

Finally, at some point during the processing of the rocker arm 25, and anytime after the step of folding the surface portions 31E and 33E about the fold regions 51 and 53, it is probably desirable (although not essential to the invention) to weld or braze the "facing" portions of the surface portions 31E and 33E, such that the upper and lower of each of the surface portions is "permanently" fixed to each other, as is best shown in FIG. 7. In certain engine applications, this step may be especially beneficial in adding stiffness and durability to the rocker arm 25.

It should also be understood that, although the bending and forming method steps have been described as occurring in a particular order, such as bending the fold locations 45 and 47 after first bending the fold regions 51 and 51, such is not essential to the invention.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rocker arm for use in a valve control system of an internal combustion engine, including an engine poppet valve adapted to be moved between open and closed positions in response to rotation of a camshaft having first and second cam profiles, each cam profile including a base circle portion and a lift portion; said rocker arm comprising first and second sidewall portions, substantially parallel to an axis and a connecting portion interconnecting said first and second sidewall portions; said rocker arm being formed from a flat sheet metal bank having a nominal thickness; characterized by:

(a) each of said first and second sidewall portions including an enlarged portion defining a fold region whereby, after each of said enlarged portions is folded over on itself along said fold region, and said blank is formed to comprise said rocker arm, said fold regions are parallel to, and equally and oppositely disposed about, said rocker arm axis; and (b) said first and second enlarged portions, after being folded, comprise first and second cam contact surfaces, respectively, for engagement with said first and second cam profiles, respectively, each of said cam contact surfaces having a width, in a direction perpendicular to said rocker arm axis, wherein said width is substantially greater than said nominal thickness of said sheet metal blank.

2. A rocker arm as claimed in claim 1, characterized by each of said first and second cam contact surfaces being subjected to at least one finishing operation, subsequent to said forming of said rocker arm.

3. A rocker arm as claimed in claim 2, characterized by said finishing operation comprising a grinding operation.

4. A rocker arm as claimed in claim 1, characterized by said flat sheet metal blank comprising a low carbon steel member.

5. A rocker arm as claimed in claim 4, characterized by said finishing operation, subsequent to said forming of said rocker arm, comprises altering the metallurgy of said first and second cam contact surfaces.

6. A rocker arm as claimed in claim 4, characterized by said finishing operation, subsequent to said forming of said rocker arm, comprises heat treating of said first and second cam contact surfaces.

7. A rocker arm as claimed in claim 1, characterized by each of said first and second enlarged portions comprises, after said enlarged portion is folded over on itself along said fold region, an inner portion and an outer portion, said inner and outer portions being in face-to-face engagement with each other over a major portion thereof.

8. A rocker arm as claimed in claim 7, characterized by said inner portion and said outer portion being fixed to each other in a permanent manner.

9. A method of forming a rocker arm from a flat sheet metal blank having a nominal thickness, said rocker arm being adapted to engage first and second cam profiles defined by a camshaft; said rocker arm having first and second sidewall portions, adapted to be engaged by said first and second cam profiles, respectively, and a connecting portion interconnecting said first and second sidewall portions; said rocker arm defining a rocker arm axis oriented generally perpendicular to said connecting portion; said method of forming comprising, in any order, the steps of:

(a) forming said flat sheet metal blank into a generally U-shaped configuration wherein said connecting portion remains generally perpendicular to said axis, and said first and second sidewall portions are oriented substantially parallel to said axis; and (b) folding said first and second sidewall portions over upon themselves, whereby said first and second sidewall portions provide first and second cam contact surfaces, respectively, adapted to engage said first and second cam profiles, respectively, each of said cam contact surfaces having a width, in a direction perpendicular to said rocker arm axis, wherein said width is substantially greater than said nominal thickness of said sheet metal blank.

10. A method of forming a rocker arm as claimed in claim 9, comprising the additional step, subsequent to said steps (a) and (b), of finishing said cam contact surfaces to provide said surfaces with a curved configuration.

* * * * *